US009795867B1

(12) United States Patent
Hughes

(10) Patent No.: US 9,795,867 B1
(45) Date of Patent: Oct. 24, 2017

(54) REMOTE-CONTROLLED BOARD GAME SYSTEM AND METHOD

(71) Applicant: CONTINUUM GAMES, INC., Indianapolis, IN (US)

(72) Inventor: Greg Hughes, Indianapolis, IN (US)

( * ) Notice: Subject to any disclaimer, the term of this patent is extended or adjusted under 35 U.S.C. 154(b) by 138 days.

(21) Appl. No.: 14/808,392

(22) Filed: Jul. 24, 2015

Related U.S. Application Data

(60) Provisional application No. 62/028,722, filed on Jul. 24, 2014.

(51) Int. Cl.
*A63F 3/00* (2006.01)

(52) U.S. Cl.
CPC ..... *A63F 3/00574* (2013.01); *A63F 3/00643* (2013.01); *A63F 2003/00725* (2013.01)

(58) Field of Classification Search
CPC .... A63F 3/00; A63F 3/00643; A63F 3/00697; A63F 3/00574; A63F 3/00261; A63F 3/00173; A63F 3/00716; A63F 2003/00747
See application file for complete search history.

(56) References Cited

U.S. PATENT DOCUMENTS 6,443,796 B1 * 9/2002 Shackelford ..... A63H 33/042 273/237
2008/0309010 A1 * 12/2008 Bowling ..... A63F 3/00697 273/243
2013/0267309 A1 * 10/2013 Robbins ..... A63F 9/24 463/31
2013/0300061 A1 * 11/2013 Ben Ezra ..... A63H 33/42 273/157 R

* cited by examiner

*Primary Examiner* — Raleigh W Chiu
(74) *Attorney, Agent, or Firm* — Polsinelli PC

(57) ABSTRACT

A board game is disclosed that includes at least two remote-controlled figures moving on a game board. Each of at least two remote-controlled figures moves to knock over an opponent's building models situated at predetermined build sites on the game board. A method of playing the game is also disclosed that includes: each player selecting a remote-controlled figure and a plurality of building models; situating each remote-controlled figure at a predetermined start site on the game board; situating the building models at the plurality of predetermined build sites on the game board; and moving each remote-controlled figure to knock down an opponent's plurality of building models.

22 Claims, 16 Drawing Sheets

REMOTE-CONTROLLED BOARD GAME SYSTEM AND METHOD

CROSS REFERENCE TO RELATED APPLICATIONS

This application claims the priority of U.S. Provisional Patent Application No. 62/028,722, filed Jul. 24, 2014 which is hereby incorporated by reference in its entirety.

FIELD OF THE DISCLOSURE

Aspects of the present disclosure relate to board games and methods of playing board games. More specifically, the present disclosure relates to board game systems and methods that include remote-controlled figures interacting on a game board.

BACKGROUND

Board games involving remote-controlled moving toys are relatively rare, especially given the widespread popularity of video games that include simulations of characters, vehicles, and various other objects that may be remotely controlled and manipulated via a game controller or computer keyboard. Existing board games that include remote-controlled objects moving on the game board are typically limited to either remote-controlled vehicles such as cars that typically interact by either racing or crashing into one another, or sports figures such as football or soccer players that execute pre-programmed plays against one another. Those games involving remote-controlled vehicles allow individual players considerable flexibility with respect to the possible maneuvers of the vehicles, but there is little strategy required to outrace, incapacitate, or eject an opponent's vehicle. Those games that involve remote-controlled sports figures involve more strategy, but the movements of the figures are typically limited to pre-programmed movements to implement a limited list of plays. A need exists for a board game involving remote-controlled figures which involves strategic planning and execution, while also allowing the players considerable flexibility and variability in the movements of the remote-controlled figures.

SUMMARY OF THE INVENTION

In one aspect, a method of playing a game that includes at least two remote-controlled figures and a plurality of building models is provided. The at least two figures may knock over at least a portion of the plurality of building models. This method may include: each player selecting one of the at least two figures and one corresponding remote control; each player obtaining a plurality of building models associated with the selected figure; each player placing the selected figure on one of a plurality of start sites on a game board; each player situating each building model at one of a plurality of build sites on the game board; all players moving all figures by manipulating the corresponding remote controls, each player's figure moving to knock over those building models associated with an opponent of said player; and declaring a winner of the game, the winner comprising that player with at least one standing building model when all other building models associated with an opponent of said player are knocked over. Each building model may include one or more building units.

Each player may choose one of the at least two figures in a first sequence determined by a first sequence rule selected from one of: a random sequence according to a first random outcome comprising a dice roll, a card draw, or a coin toss; an age-based sequence according to each player's age selected from oldest player to youngest player or vice-versa; and a sequence based on the winning status of each player in a previously played game. Each controller associated with each selected figure may be identifiable by at least one of: a common color of each controller and each figure; an external marking on each controller associated with each figure, the external marking chosen from one or more of: an image of one figure, a written name of one figure, and a surface adornment associated with one figure. Each portion of the plurality of building units associated with each figure may be identifiable by at least one of: a common color of each building unit associated with each figure; an external marking on each building unit associated with one figure, the external marking chosen from one or more of: an image of the one figure, a written name of the one figure, and a surface adornment associated with the one figure. Each building model may include a single building unit. Each building model may include at least two building units, and the method may further include assembling each building model by stacking at least two of the plurality of building units associated with that player's selected figure.

Each player may place the selected figure on one of the plurality of start sites in a second sequence determined by a second sequence rule selected from one of: the first sequence used to choose the figures; a reverse sequence to the first sequence; a sequence based on the winning status of each player in a previously played game; a second random sequence according to a second random outcome comprising a dice roll, a card draw, or a coin toss; and a figure-related sequence according to a predetermined sequence of character placement. Each player may situate each of the at least one building models on each build site in a third sequence determined by a third sequence rule selected from one of: the first sequence used to choose the figures; the second sequence used to place the figures; a sequence based on the winning status of each player in a previously played game; a third random sequence according to a third random outcome comprising a dice roll, a card draw, or a coin toss; and a figure-related sequence according to a predetermined sequence of character placement. The third sequence may further include: each player situating all of the building models associated with that player's figure in one turn, followed by a next player in the third sequence situating all of the building models associated with that next player's figure, until all building models associated with all figures are situated; or each player situating one of the building models associated with that player's figure, followed by a next player situating one of the building models associated with that next player in a repeating cycle until all building models associated with all figures are situated. Each building model may include an equal number of building units to all other building models. An equal number of building models may be associated with each player.

Each figure may move in one of at least two modes at any given time, including: a translation mode that includes translation in a single linear direction; and a rotation mode that includes rotation in a single rotational direction. Each figure may change location on the game board using a combination of these two modes. Each figure may knock over using only the rotational mode of movement. Each figure may be returned to a new start site on the game board if the figure falls over or leaves the game board, the new start site chosen from: the start site originally chosen for the figure; a start site nearest the location of the figure when the figure falls over or leaves the game board; a start site chosen by the player associated with the figure; or a start site chosen by an opponent of the player associated with the figure.

All players may start moving all figures simultaneously by: all players holding all controllers and starting movement in response to a start signal; or all players picking up all controllers and starting movement in response to the start signal. All building units of each knocked over building model directly contact the game board or surrounding playing surface.

In another aspect, a method of playing a game comprising two remote-controlled figures and a plurality of building models is provided in which the two remote-controlled figures are moved to knock over at least a portion of the plurality of building models. The method may include: each player selecting one of the two figures and one corresponding remote control; each player obtaining a group of two or more building units associated with the selected figure; each player placing the selected figure on one of a plurality of start sites on a game board; each player situating each one or more building models at one of a plurality of build sites on the game board; each building model assembled by stacking at least two of the two or more building units associated with that player's selected figure; both players moving both figures by manipulating the corresponding remote controls, each player's figure moving to knock over those building models associated with that player's opponent; and declaring a winner of the game. The winner may be that player with at least one standing building model when all other building models associated with that player's opponent are knocked over.

Each remote-controlled figure may be configured to move about a top surface of the game board under the control of the remote. Additionally, each remote-controlled figure comprises a central torso ending in a head and a base at opposite ends of the torso, and one or more arms projecting laterally from the torso between the head and the base. The one or more arms may be fixedly attached to the torso in position, or may be pivotally attached to the torso. In some aspects, the first remote-controlled figure may be in the form of a gorilla character, and the second remote-controlled figure may be in the form of a lizard character.

Each remote control associated with each selected remote-controlled figure may be identifiable by at least one of: a common color of each remote control and each figure; an external marking on each remote control associated with each remote-controlled figure, the external marking chosen from one or more of: an image of one remote-controlled figure, a written name of one remote-controlled figure, and a surface adornment associated with one remote-controlled figure. Additionally, each remote control may comprise a forward button, wherein the forward button is actuated to command a linear forward movement of the associated remote-controlled figure, and each remote control may comprise a spin button, to command a spinning movement of the associated remote-controlled figure.

The building units of the game board may be stackable in a vertical manner. The building units may be assembled in a vertical stack on a top surface of the game board. Each set of building units may comprise 24 building units. When each set of building units comprises 24 building units, a portion of six building units of each set may be stackable to form a building model. Each set of building units associated with each remote-controlled figure may be identifiable by at least one of: a common color of each building unit associated with each remote-controlled figure; an external marking on each building unit associated with one remote-controlled figure, the external marking chosen from one or more of: an image of the one remote-controlled figure, a written name of the one remote-controlled figure, and a surface adornment associated with the one remote-controlled figure.

The game board may further comprise markings representing map features selected from streets, rivers, additional buildings, parks, and parking lots. The game board may comprise four start sites distributed throughout the game board. The plurality of start sites may be distributed around an outer perimeter of the game board. The plurality of build sites distributed throughout the game board may comprise a number of build sites greater than the total number of building models associated with each remote-controlled figure. Additionally, the plurality of build sites may be distributed on a top surface of the game board in a distribution pattern selected from random distribution, uniform distribution, clustered distribution, and distribution along markings or features of the game board.

In an additional aspect, a board game for two players is provided that includes: a first remote-controlled figure controlled by a first remote control; a second remote-controlled figure controlled by a second remote control; a first set that includes two or more building units associated with the first remote-controlled figure; a second set that includes two or more building units associated with the second remote-controlled figure; and a game board. The game board may include: a plurality of start sites distributed around an outer perimeter of the game board, each start site marking a potential initial location for the first or second remote-controlled figure; and a plurality of build sites distributed throughout the game board, each build site marking a potential location of one of the first or second building models. At least one portion of the first set may be stacked to form at least one first building model associated with the first remote-controlled figure, and at least one portion of the second set may be stacked to form at least one second building model associated with the second remote-controlled figure. Each player may control the movement of the first or second remote-controlled figure using the first or second remote control to knock over all building models associated with an opponent of that player.

In another additional aspect, a board game for at least two players is provided. The game may include: at least two remote-controlled figures and associated remote controls; a plurality of building models; and a game board. The game board may include: a plurality of start sites distributed throughout the game board, each start site marking a potential initial location for one of the at least two figures; and a plurality of build sites distributed within the outer perimeter of the game board, each build site marking a potential location of one of the plurality of building models. A portion of the plurality of building models may be associated with each of the at least two remote-controlled figures. Each player may control the movement of one of the at least two remote-controlled figures using the associated remote control to knock over the portions of the building models associated with one or more opponents of that player.

The plurality of start sites may be distributed around an outer perimeter of the game board, and the plurality of build sites may be configured to receive the plurality of building models. Each frangible building model may comprise a plurality of building units stacked on top of each other. Each frangible building model may be assembled by stacking a plurality of building units, wherein the base of a first building unit rests on a build site, and a base of a second building is stacked on top of the first building unit in a repeating cycle until the frangible building model is assembled.

While multiple embodiments are disclosed, still other embodiments of the present disclosure will become apparent to those skilled in the art from the following detailed description, which shows and describes illustrative embodiments of the disclosure. As will be realized, the disclosure is capable of modifications in various aspects, all without departing from the spirit and scope of the present disclosure. Accordingly, the drawings and detailed description are to be regarded as illustrative in nature and not restrictive.

BRIEF DESCRIPTION OF THE DRAWINGS

The following figures illustrate various aspects of the disclosure.

Corresponding reference characters and labels indicate corresponding elements among the views of the drawings. The headings used in the figures should not be interpreted to limit the scope of the claims.

DETAILED DESCRIPTION

Figure 1:
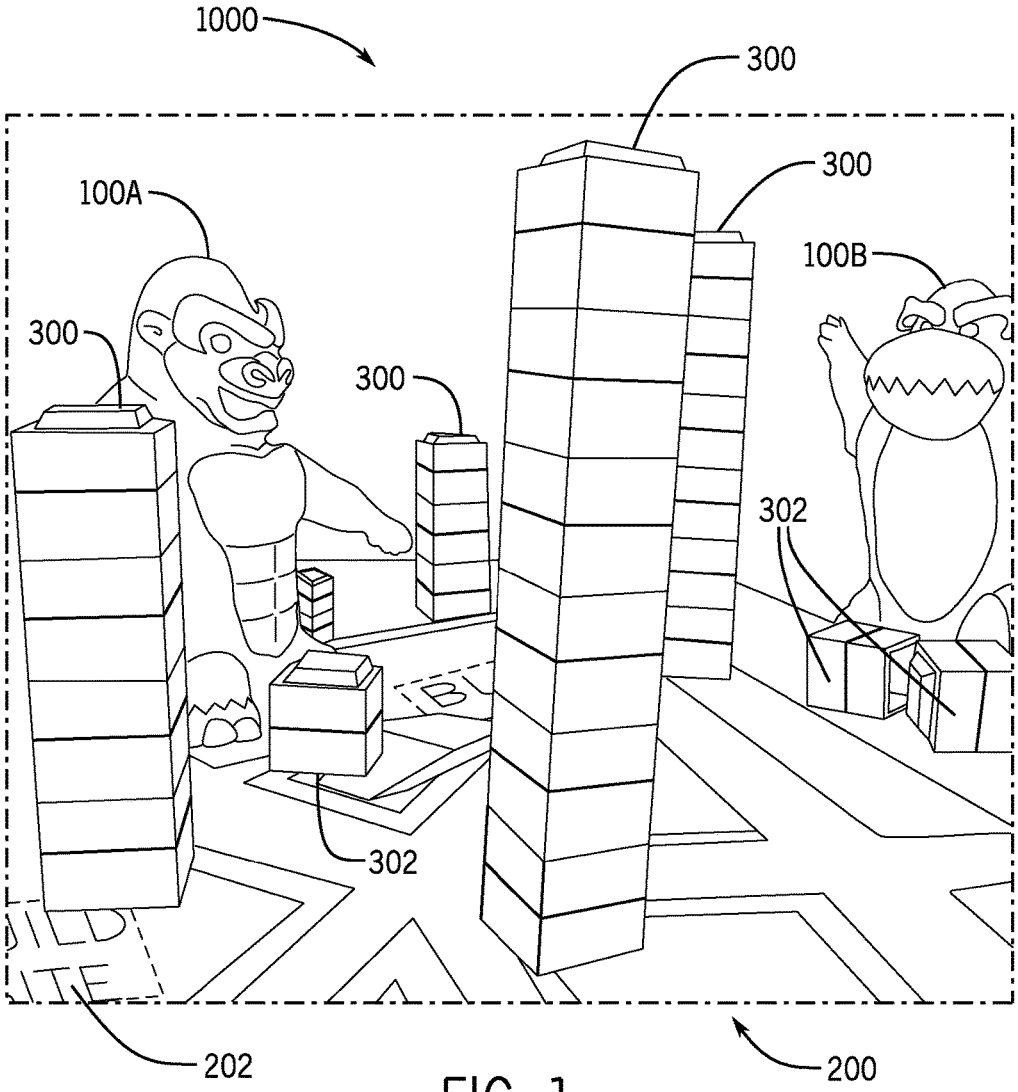
FIG. 1 is an illustration of two remote-controlled figures interacting on a game board.

In various aspects, a game for at least two players is disclosed that includes at least two remote-controlled figures interacting on a game board. Referring to FIG. 1, in various aspects, a game 1000 is shown which may include at least two remote-controlled figures 100A/100B interacting on a game board 200. In an aspect, a player's figure 100A may move on the game board 200 in order to knock over at least one building model 300 associated with an opponent, to defend the player's own building models 300, to topple an opponent's figure 100B, and/or to force an opponent's figure off of the game board. In some aspects, each building model 300 may be made up of two or more stacked building units 302.

In various other aspects, a method for playing the game 1000 is disclosed that includes each player selecting a remote control figure 100, assembling and/or placing the building models 300 onto a portion of predetermined build sites 202 distributed on the game board 200. The method for playing the game 1000 may further include moving all players' remote-controlled figure 100 to knock over all building models 300 associated with each player's opponents. The various components of the game 1000 and the method for playing the game 1000, as described herein in various aspects, provide a rich environment for an interactive and strategic game experience involving remote-controlled figures.

I. Game Board

Figure 2:
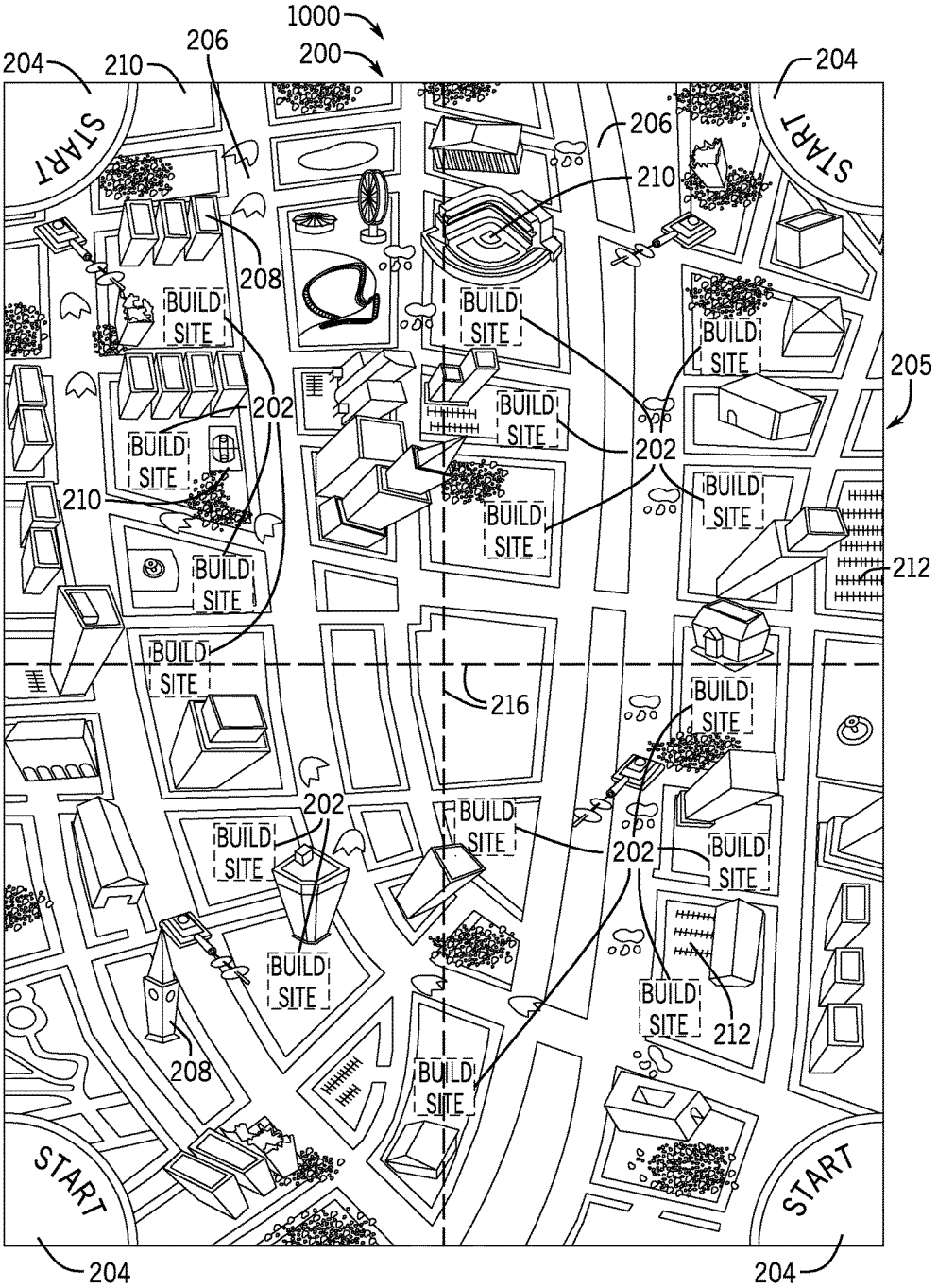
FIG. 2 is a top view of a game board.

In various aspects, the game 1000 may include a game board 200 that may be a planar sheet of a material having a top surface 205 and a bottom surface (not shown). The game board 200 may be provided with any planform profile without limitation. The term planform, as used herein, refers to a shape of an outer perimeter of the game board 200 as viewed from above the game board 200. Non-limiting examples of suitable planform profiles for the game board 200 include: square, rectangular, circular, elliptical, and any polygon such as triangular, pentagonal, hexagonal, and the like. Referring to FIG. 2, an aspect of the game board 200 having a rectangular planform profile is shown. The game board 200 may further be provided with a plurality of markings to demarcate various sites used in the game and to further provide contextual details to enhance the game experience.

Figure 3:
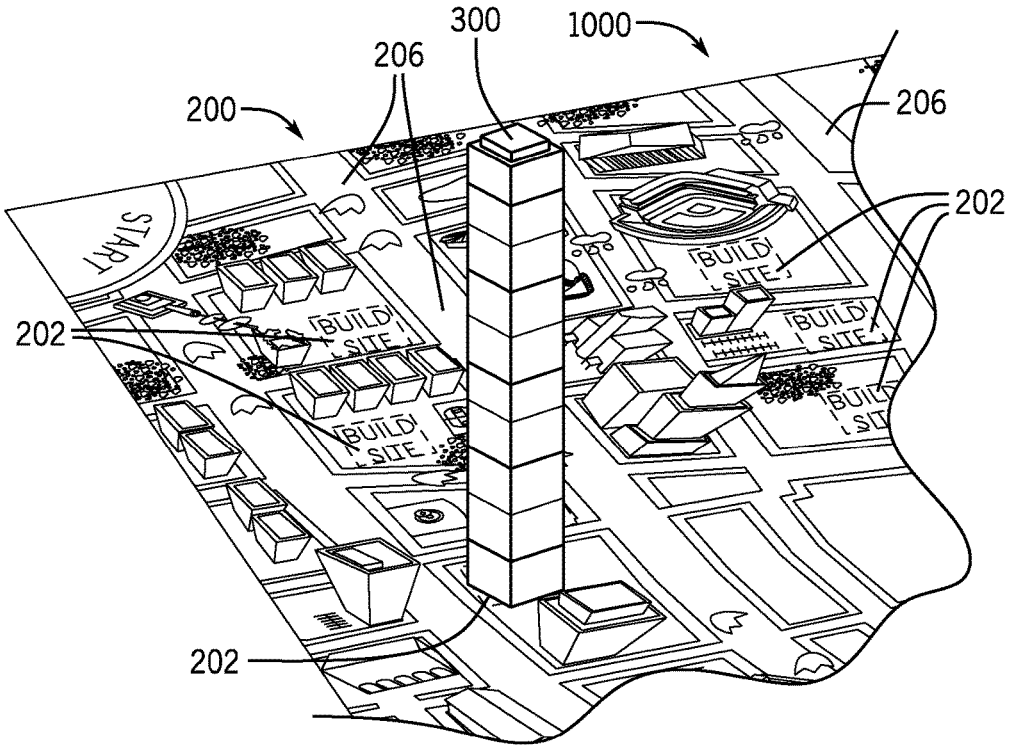
FIG. 3 is an illustration of a building model situated on a game board at a build site.

Referring again to FIG. 2, the game board 200 may include markings on the top surface 205 of the game board 200 demarcating a plurality of build sites 202. Each build site 202 demarcates a region of the game board 200 in which a building model 300 may be located by a player of the game 1000. The build sites 202 may be distributed throughout the exposed area of the game board 200 in any known distribution pattern without limitation. Non-limiting examples of suitable distribution patterns for the build sites 202 include: random distribution, uniform distribution, clustered distribution, and distribution along additional markings or features of the game board 200 that may further provide contextual details to enhance the game experience. By way of non-limiting example, a plurality of build sites 202 may be distributed along an additional marking 206 on the game board 202 representing a street or a river, as illustrated in FIG. 2. Referring to FIG. 3, a building model 300 is shown placed on a build site 202.

In one aspect, the number of build sites 202 on the game board 200 may be equal to the total number of building models 300 associated with all players of the game 1000. In this one aspect, the players may be challenged to make strategic use of a limited number of build sites 202. In another aspect, the total number of build sites 202 may be greater than the total number of building models 300 associated with all players of the game 1000. In various aspects, the number of build sites 202 on the game board 200 may range from about 4 to about 30. In various other aspects, the number of build sites 202 on the game board 200 may range from about 8 to about 24, from about 12 to about 18, and from about 14 to about 18.

Figure 4:
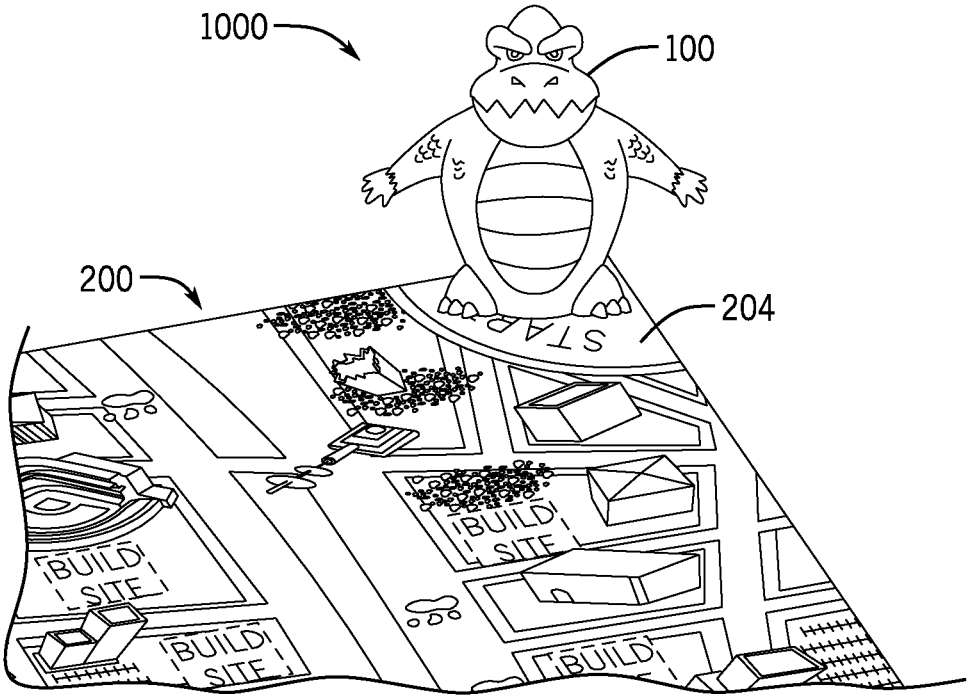
FIG. 4 is an illustration of a remote-controlled figure placed on a game board at a start site.
Figure 5A:
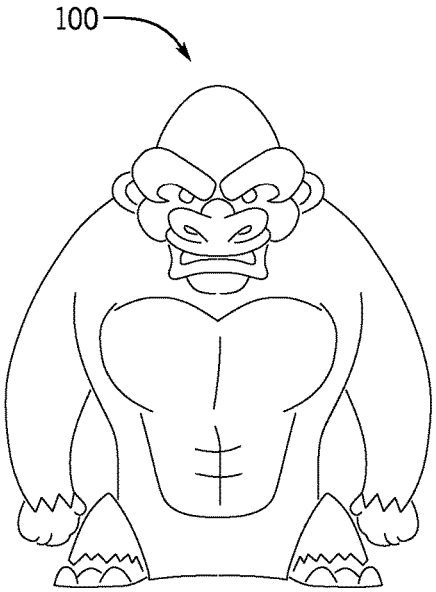
FIGS. 5A-5D are front, back, side, and top views, respectively, of a gorilla remote-controlled figure.
Figure 5B:
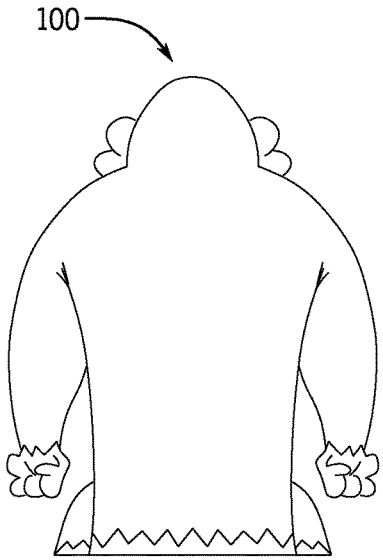
Figure 5C:
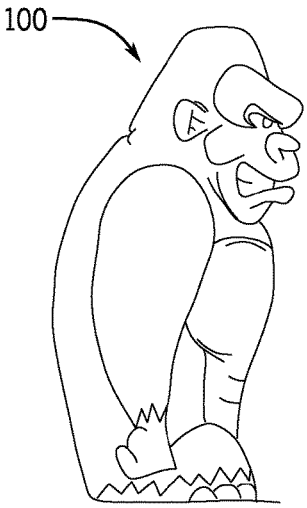
Figure 5D:
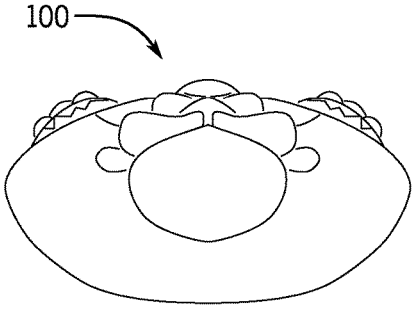
Figure 6A:
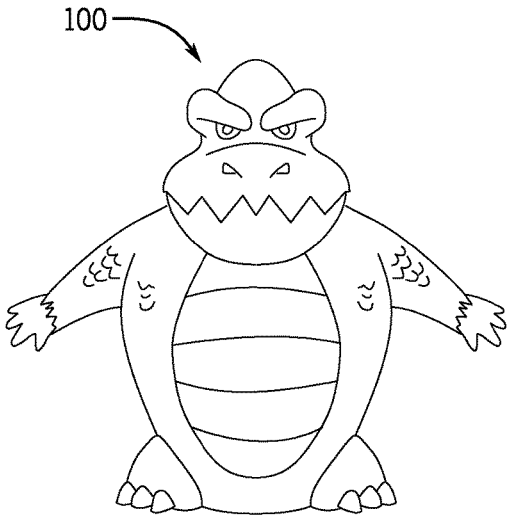
FIGS. 6A-6D are front, back, side, and top views, respectively, of a lizard remote-controlled figure.
Figure 6B:
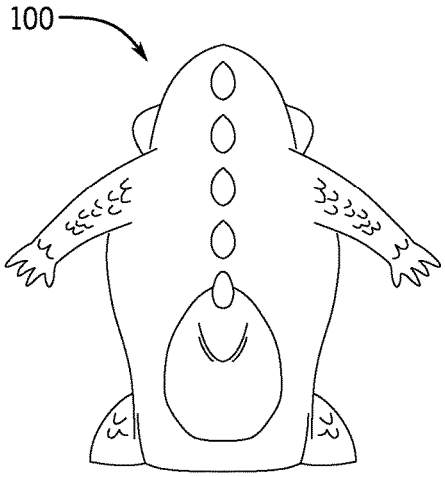
Figure 6C:
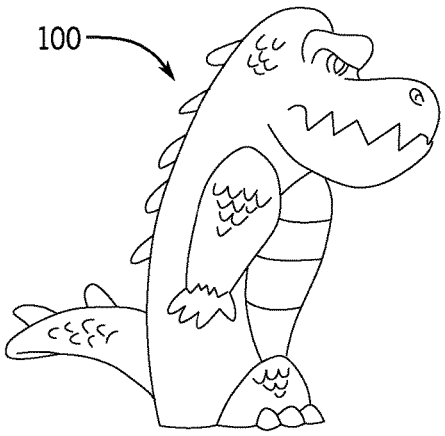
Figure 6D:
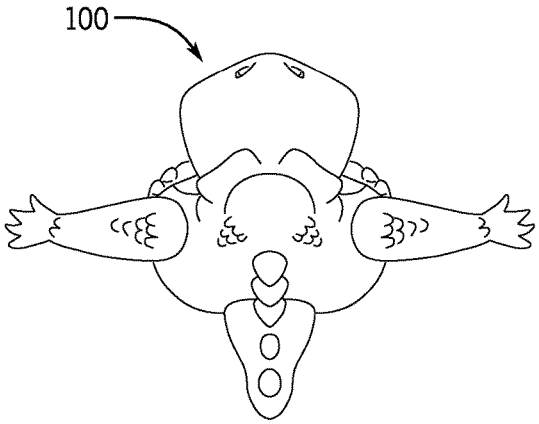

Referring again to FIG. 2, the game board 200 may additionally include a plurality of start sites 204 in various aspects. Each start site 204 demarcates a region of the game board 200 in which a remote-controlled figure 100 may be located by a player of the game 1000 prior to initiating the movement of the remote-controlled figure 100 during game play. In addition, each start site 204 demarcates a region of the game board 200 in which a remote-controlled figure 100 may be returned to play by a player following that player's remote-controlled figure 100 either falling over and/or leaving the game board during game play according to the rules of play, as described herein below. Referring to FIG. 4, a remote-controlled figure 100 is shown located on a start site 204 situated at one corner of the game board 200.

In various aspects, the plurality of start sites 204 may be situated anywhere on the game board 200 without limitation. In some aspects, the plurality of start sites 204 may be situated anywhere around a perimeter of the game board 200. In one aspect, each start site 204 may be situated at one corner of the game board 200, as illustrated in FIG. 2. In another aspect (not shown), one or more of the start sites 204 may be situated on the perimeter of the game board 200 between two adjacent corners of the game board 200.

In one aspect, the total number of start sites 204 may be equal to the total number of remote-controlled figure 100 associated with all players of the game 1000. In this one aspect, the players may be challenged to make strategic use of a limited number of start sites 204. In another aspect, the total number of start sites 204 may be greater than the total number of remote-controlled figure 100. In various aspects, the number of start sites 204 on the game board 200 may range from about 2 to about 10.

Referring again to FIG. 2, the game board 200 may further include additional markings representing additional features, including map features. Non-limiting examples of suitable map features include: streets or rivers 206, additional buildings 208, parks 210, parking lots 212, and any other known map feature. In one aspect, the game board 200 may include map features that are generic in nature. In other aspects, the game board 200 may include map features that are customized to represent a known city or other known location. By way of non-limiting example, the game board 200 may include map features that represent a specific city, such as the city of London, New York, San Francisco, Tokyo, or any other city without limitation. By way of another non-limiting example, the game board 200 may include map features that represent a specific known location within a known city, such as the Piccadilly Circus in London, Times Square in New York City, the St. Louis Arch, or any other known location without limitation.

In one aspect, the game board 200 may be formed of a single continuous sheet. Referring again to FIG. 2, when the game board 200 is formed of a single continuous sheet, the game board 200 may further include one or more hinged fold lines 216 to provide the capability to fold the game board 200 in half or in quarters using methods known in the art for compact storage.

In an aspect, the game board 200 may be a single unit as illustrated in FIG. 2. In another aspect (not shown), the game board 200 may be a modular unit that may be combined with additional game boards 200 to provide an enlarged play surface. By way of non-limiting example, a first game board 200 with markings representing Times Square in New York City may be combined with another game board 200A with markings representing Wall Street in New York City to provide an enlarged playing surface. In this other aspect, the modular game boards 200 may be combined by aligning corresponding edges of the two game boards 200/200A. In this other aspect, the corresponding edges of the game boards 200/200A may further include a locking mechanism to maintain the alignment of the corresponding edges during game play. Non-limiting examples of suitable locking mechanisms include Velcro fasteners, interlocking tabs, reversibly adhesive strips, magnetic fasteners, and any other known locking mechanism.

In various aspects, the size of the game board 200 may be influenced by one or more of at least several factors, including, but not limited to: the size and number of the remote-controlled figure 100, the speed and maneuverability of the remote-controlled figure 100, the size and number of building models 300, the intended location of the game board 200, the intended number of players that may play the game 1000, and any other relevant factor known in the art. A game 1000 including relatively large and/or relatively high numbers of remote-controlled figure 100 and/or relatively large and/or relatively high numbers of building models 300 may include a relatively large game board 200. A game 1000 including remote-controlled figure 100 that move with relatively high speed and/or relatively limited maneuverability may require more space to move, and thus may include a relatively large game board 200.

In various aspects, the game board 200 may be any size without limitation. In one aspect, each edge of the game board may range in length from about 0.3 m to about 2 m. In other aspects, each edge of the game board may be larger than about 0.3 m, larger than about 0.4 m, larger than about 0.5 m, larger than about 0.6 m, larger than about 0.7 m, larger than about 0.8 m, larger than about 0.9 m, larger than about 1 m, larger than about 1.2 m, larger than about 1.4 m, larger than about 1.6 m, and larger than about 1.8 m. In other aspects, each edge of the game board may be smaller than about 0.4 m, smaller than about 0.5 m, smaller than about 0.6 m, smaller than about 0.7 m, smaller than about 0.8 m, smaller than about 0.9 m, smaller than about 1 m, smaller than about 1.2 m, smaller than about 1.4 m, smaller than about 1.6 m, smaller than about 1.8 m, and smaller than about 2.0 m.

II. Remote-Controlled Figures

Referring again to FIG. 1, in various aspects the game 1000 may include at least two remote-controlled figures 100A/100B that may move about the game board 200 to knock over an opponent's building models 300. In various aspects, the number of remote-controlled figure 100 provided with the game 1000 may range from about 2 to about 10.

Figure 7A:
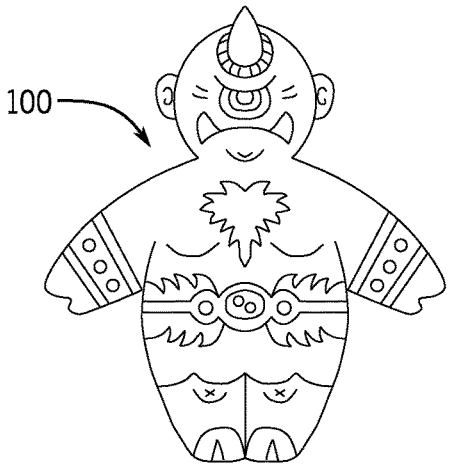
FIGS. 7A-7F are front views of additional remote-controlled figures: a Cyclops (FIG. 7A), a robot (FIG. 7B), a Cthulhu (FIG. 7C), a werewolf (FIG. 7D), a zombie (FIG. 7E), and an alien (FIG. 7F).
Figure 7B:
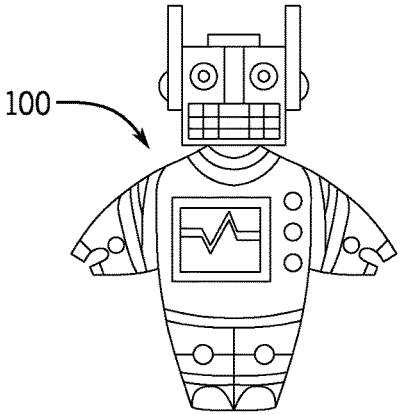
Figure 7C:
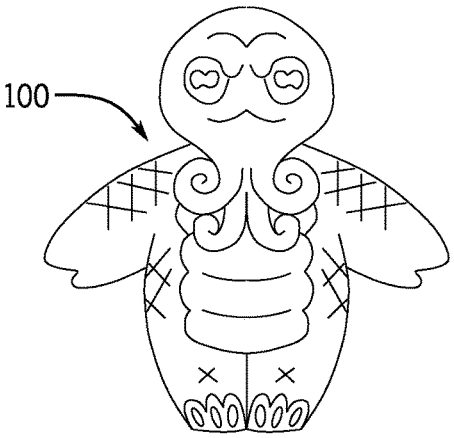
Figure 7D:
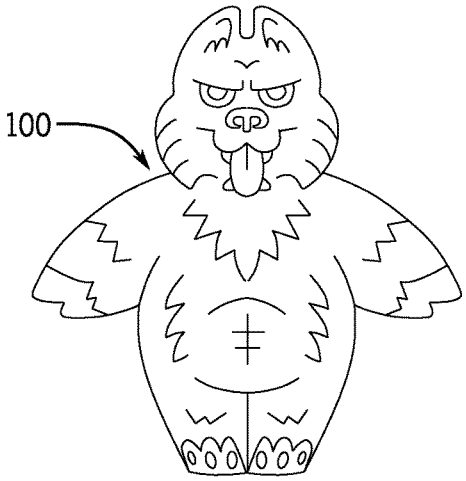
Figure 7E:
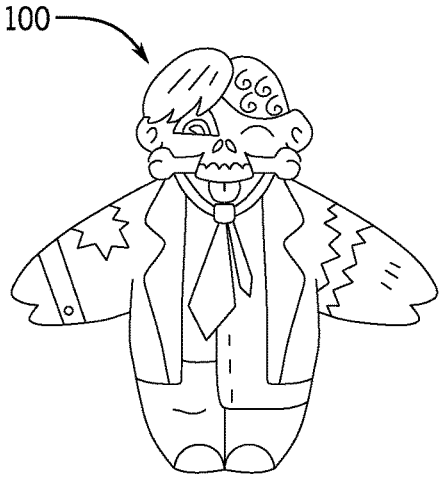
Figure 7F:
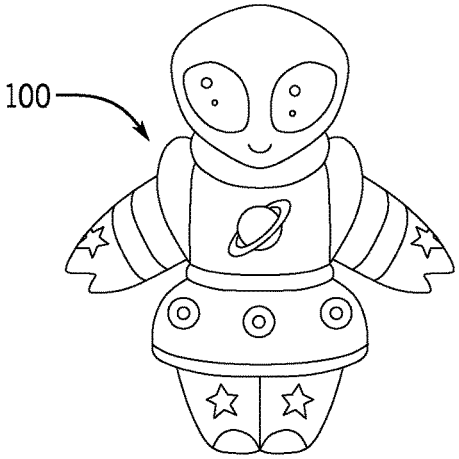

FIGS. 5A-5D provide front, rear, side, and top views of a remote-controlled figure 100 in one aspect. In one aspect, the remote-controlled figure 100 may be provided in the form of a vehicle, including, but not limited to, a monster truck, a pick up truck, a semi truck, a car, a motorcycle, or any other vehicle without limitation. The remote-controlled figure 100 may be provided in the form of a character, including, but not limited to, a gorilla character as illustrated in FIGS. 5A-5D. In another aspect, the remote-controlled figure 100 may be provided in the form of any character without limitation. Non-limiting examples of suitable characters include: various human characters such as military figures, law enforcement figures, politicians, royalty, historical figures, celebrities, and the like, various animals such as a gorilla (see FIGS. 5A-5D), a shark, an octopus, a bear, a wolf, a snake, and the like; various animated characters; and various monsters such as a lizard (see FIGS. 6A-6D), a Cyclops (see FIG. 7A), a robot (see FIG. 7B), a Cthulhu (see FIG. 7C), a werewolf (see FIG. 7D), a zombie (see FIG. 7E), and an alien (see FIG. 7F).

In other aspects, each remote-controlled figure 100 may be provided with a unique color to visually distinguish each remote-controlled figure 100 during game play. In addition, a portion of the building models 300 may be provided with the unique color assigned to one remote-controlled figure 100 to associate the portion of the building models 300 to that one remote-controlled figure 100. Further, each controller used to control the motion of one remote-controlled figure 100 may be provided with a color matched to the unique color of that one remote-controlled figure 100. In these aspects, the color-coding of the remote-controlled figure 100 and associated controller, as well as the building models 300 associated with the remote-controlled figure 100, provide an unambiguous differentiation between each player's remote-controlled figure 100 and building models 300 and the corresponding remote-controlled figure 100 and building models 300 of the opponents.

Figure 8:
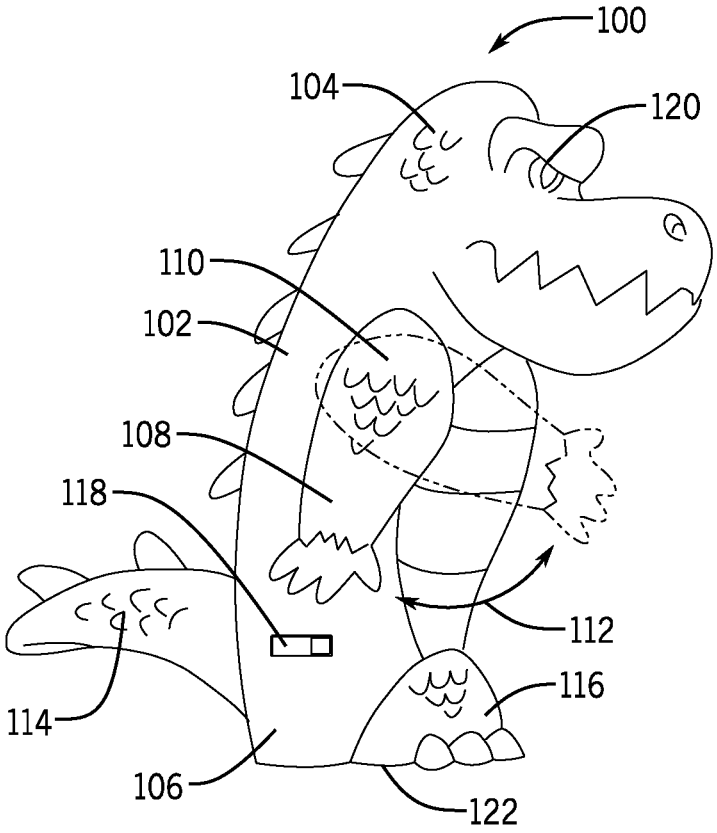
FIG. 8 is a side view of a lizard remote-controlled figure.

Referring to FIG. 8, when the remote-controlled figure 100 is provided in the form of a character, the remote-controlled figure 100 may include a central torso 102 ending in a head 104 and a base 106 at opposite ends of the torso 102. In various aspects, the remote-controlled figure 100 may further include one or more arms 108 projecting laterally from the torso between the head 104 and the base 106. In one aspect, the one or more arms 108 may be affixed to the torso 102 in a fixed position or formed as a continuous structure with the torso 102 such that the one or more arms 108 are fixed in position. In another aspect, the one or more arms 108 may be attached to the torso 102 at a pivoted joint 110 as illustrated in FIG. 8. In this aspect, the pivoted joint 110 may permit positioning an arm 108 at any orientation within an angular range 112. The pivoted joint 110 may be any known joint suitable for joining the arm 108 to the torso 102 including, but not limited to: a pin joint, a hinge joint, a ball-and-socket joint, and any other known joint. In various aspects, the angular range 112 may be limited by the type of joint 110, and may extend laterally toward and away from the side of the remote-controlled FIG. 100 and/or forward and backward as illustrated in FIG. 8.

In various aspects, the remote-controlled figure 100 may include other appendages projecting from the torso 102 without limitation. The other appendages may include additional appendages associated with the body of the remote-controlled FIG. 100 including, but not limited to, a tail 114, one or more feet 116, and the like as illustrated in FIG. 8. The other appendages may also include additional objects held or worn by the remote-controlled figure 100 including, but not limited to: clothing, armor, weapons such as swords, lances, shields, and the like.

Referring again to FIG. 8, the remote-controlled figure 100 may further include an on/off switch 118 to connect a motor, actuators, and associated circuitry (not shown) to a power source (not shown) within the remote-controlled figure 100. The switch 118 may be located anywhere on the exterior surface of the remote-controlled figure 100 without limitation. The remote-controlled figure 100 may include any known type of electric switch without limitation. Non-limiting examples of suitable switch types include: a sliding switch as illustrated in FIG. 8, a toggle switch, a push button switch, a touch pad switch, and any other suitable switch type known in the art.

In various additional aspects, the remote-controlled figure 100 may include other features to enhance the playing experience of the game 1000. Referring again to FIG. 8, the head 104 of the remote-controlled figure 100 may further include one or more eyes 120 provided with lights visible through the openings of the eyes 120. Any known electrical light device may be used to light the eyes 120 without limitation including, but not limited to, LED devices. In this aspect, the lights within the eyes 120 may be activated by a controller (not shown) associated with the remote-controlled figure 100, or by the switch 118. In one aspect, the switch 118 may include three positions: a first position to deactivate the remote-controlled figure 100, a second position to activate the remote-controlled figure 100 without lighting the eyes 120, and a third position to activate the remote-controlled figure 100 and light the eyes 120.

In other aspects, the remote-controlled figure 100 may include an internal speaker (not shown) to produce sounds including, but not limited to, animal noises such as roars and the like; movement-associated noises such as motor noises, screeching tires, and the like; crashing noises such as breaking glass, smashing noises, cracking noises, and the like; and music excerpts. In various aspects, the internal speaker may be activated by a controller (not shown) associated with the remote-controlled figure 100, or by the switch 118. In one aspect, the activated speaker produces a single noise. In another aspect, the activated speaker produces one of several sounds stored in the associated circuitry within the remote-controlled figure 100. In this other aspect, the sound that is produced may be selected in a fixed and rotating order, or the sound may be selected at random from the several stored sounds. In yet another aspect, the activated speaker may produce one of several sounds based on the position of the switch 118 and/or the state of the controller (not shown). By way of non-limiting example, the activated speaker may produce a screeching tire sound when the controller commands a forward movement of the remote-controlled figure 100, a crashing sound when the controller commands a spinning movement of the remote-controlled figure 100, and/or a laser sound when the controller activates the lights in the eyes 120 of the remote-controlled figure 100.

Figure 9A:
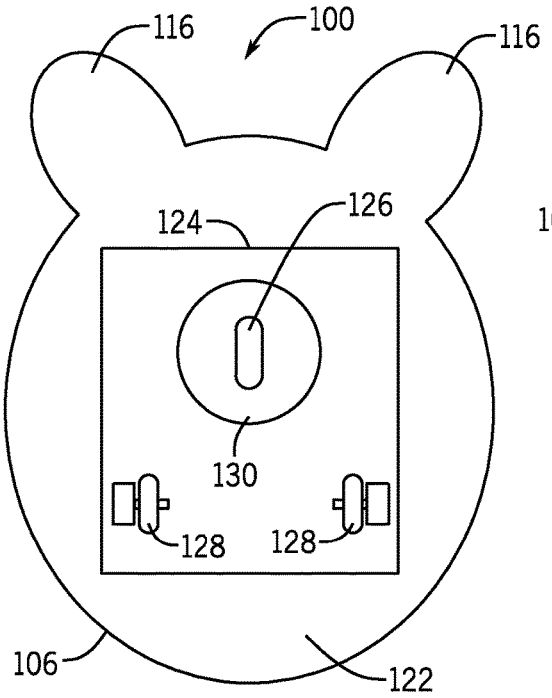
FIG. 9A is a bottom view of a remote-controlled figure showing an undercarriage during a forward movement.
Figure 9B:
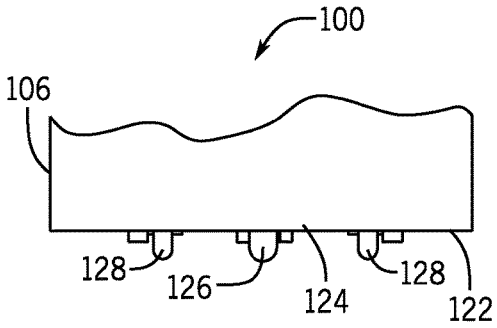
FIG. 9B is a front view of a lower portion of a remote-controlled figure showing an undercarriage during a forward movement.
Figure 9C:
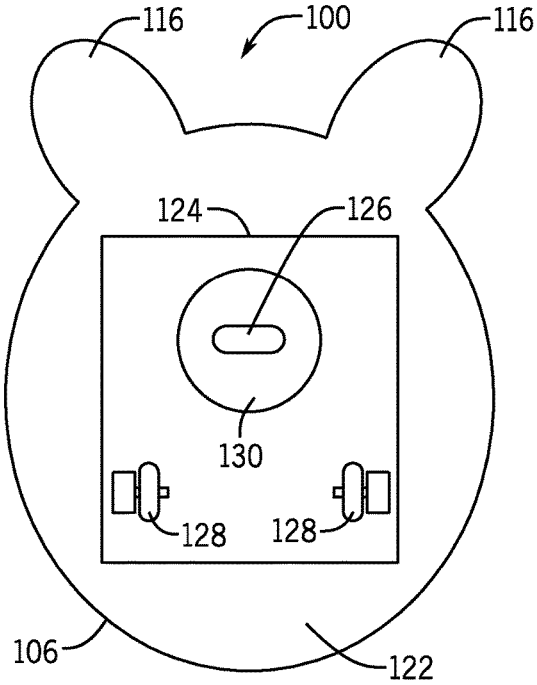
FIG. 9C is a bottom view of a remote-controlled figure showing an undercarriage during a spinning movement.

Referring again to FIG. 8, the base 106 may end in a planar support 122 that provides a stable support surface for an undercarriage (not shown) of the remote-controlled figure 100. Referring to FIGS. 9A-9C, the undercarriage 124 is situated on the planar support 122 and actuates the movements of the remote-controlled figure 100 as commanded by the controller (not shown). The undercarriage 124 may include any known means of actuating movement without limitation including, but not limited to, one or more drive wheels powered by one or more electric motors in any arrangement. In one aspect, illustrated in FIG. 9A, the undercarriage 124 may include a powered drive wheel 126 and a pair of unpowered support wheels 128. In this aspect, the drive wheel 126 and support wheels 128 may be provided in a triangular arrangement to form a stable tripod to support the remote-controlled figure 100. As illustrated in FIG. 9B, the lower edges of the drive wheel 126 and support wheels 128 are coplanar, thereby enhancing the stability of the undercarriage 124. In addition, the drive wheel 126 is situated essentially forward of, and midway between, the support wheels 128.

Referring again to FIG. 9A, the drive wheel 126 may be mounted within a turntable 130 in one aspect. The turntable 130 may be operatively coupled to an actuator (not shown) inside the remote-controlled figure 100. Driven by the actuator, the turntable 130 may rotate clockwise and/or counterclockwise to effectuate steering movements by the remote-controlled figure 100 in various aspects. In one aspect, illustrated in FIGS. 9A and 9C, the actuator may rotate the turntable 130 to orient the drive wheel 126 into one of two positions: 1) a forward position, illustrated in FIG. 9A, in which the drive wheel 126 may be oriented parallel with the support wheels 128; and 2) a spin position, illustrated in FIG. 9C, in which the drive wheel 126 may be oriented perpendicular to the support wheels 128. Other spin positions, wherein the drive wheel 126 may be oriented at an angle other than parallel or perpendicular in relation to the support wheels 128, are also envisioned. In the forward position, the drive wheel 126 may produce a forward force that is parallel and centered midway between the support wheels 128, thereby causing movement of the remote-controlled figure 100 in a linear forward path. In the spinning position, the drive wheel 126 may produce a force perpendicular and offset to both support wheels 128, thereby causing a rotation of the remote-controlled figure 100 about an axis perpendicular to the planar support 122. In this aspect, the forward position and the spin position may be used in combination to effectuate the movements of the remote-controlled figure 100 during game play.

Figure 10:
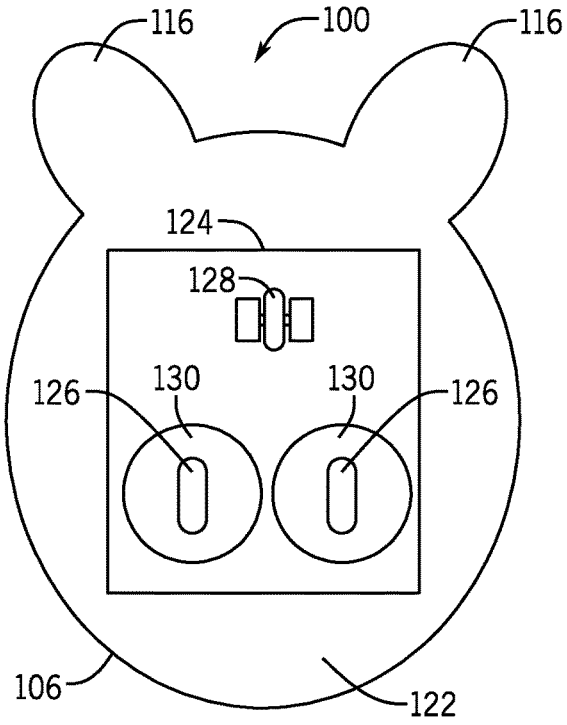
FIG. 10 is a bottom view of a remote-controlled figure showing an undercarriage with dual drive wheels during a forward movement.
Figure 11:
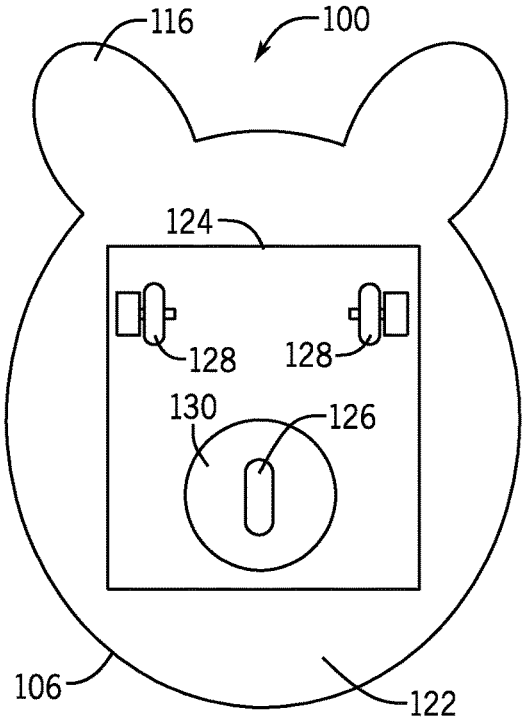
FIG. 11 is a bottom view of a remote-controlled figure showing an undercarriage with a drive wheel situated behind a pair of support wheels during a forward movement.

In other aspects, the undercarriage 124 may include drive wheel 126/support wheel 128 arrangements different from those described herein above. In some other aspects, the undercarriage may include more than one drive wheel 126. By way of non-limiting examples, the undercarriage may include two drive wheels 126 and a single support wheel 128 situated similarly to the drive wheel 126 as illustrated in FIG. 10. In this example, the two drive wheels 126 may be mounted on individual turntables 130 that may move in a coupled manner, or may move independently of one another. By way of another non-limiting example, the drive wheel 126 may be located behind the support wheels 128 as illustrated in FIG. 11, such that the drive wheel 126 pushes the support wheels 128 during forward motion rather than pulling the support wheels 128 in the arrangement previously discussed herein and illustrated in FIG. 9A. The numbers and arrangements of the drive wheels 126 and support wheels 128 may impart different stability and/or maneuverability characteristics to the remote-controlled figure 100 according to engineering principles well known in the art. In one aspect, a high degree of maneuverability of the remote-controlled figure 100 may be desirable to enhance the ability to dodge an opponent's remote-controlled figure 100 and knock over an opponent's building models 300. In another aspect, a certain degree of instability may be desired for the remote-controlled figure 100 to enhance the challenge of moving around the game board 200 without falling over or leaving the game board 200.

In various aspects, the height of the remote-controlled figure 100 may range in size from about 2 cm to about 50 cm. In various other aspects, the height of the remote-controlled figure 100 may range in size from about 2 cm to about 4 cm, from about 3 cm to about 5 cm, from about 4 cm to about 6 cm, from about 5 cm to about 7 cm, from about 6 cm to about 8 cm, from about 7 cm to about 9 cm, from about 8 cm to about 10 cm, from about 9 cm to about 11 cm, from about 10 cm to about 20 cm, from about 15 cm to about 25 cm, from about 20 cm to about 30 cm, from about 25 cm to about 35 cm, from about 30 cm to about 40 cm, from about 35 cm to about 45 cm, and from about 40 cm to about 50 cm.

III. Controllers

Figure 12A:
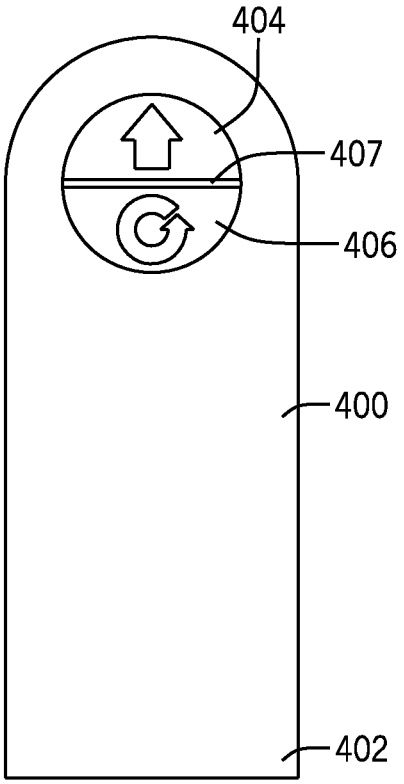
FIGS. 12A-12C are front, back, and top views of a controller, respectively.
Figure 12B:
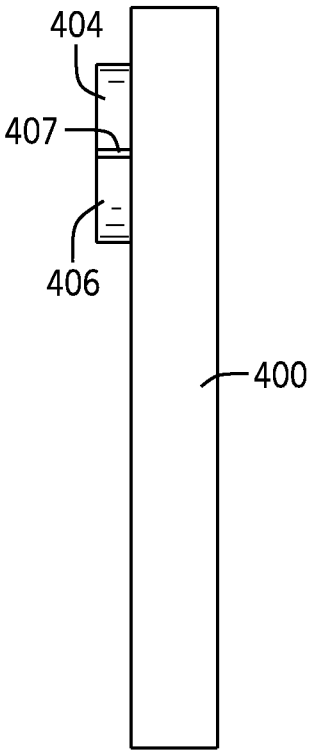
Figure 12C:
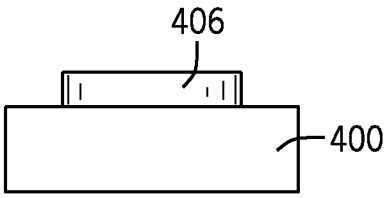

In various aspects, the game 1000 may further include at least two controllers used to control the movements of the at least two remote-controlled figure 100. Referring to FIGS. 12A-12C, each controller 400 includes a case 402 that contains an antenna, power source, and associated circuitry (not shown) to receive commands from a player via a control interface such as a forward button 404 and a spin button 406 illustrated in FIGS. 12A-12C, and to relay these commands via wireless signals to the corresponding remote-controlled figure 100. In other aspects, the case 402 may be shaped to fit comfortably within a player's hand to facilitate the use of the controller 400 during game play and to provide easy access to the forward button 404 and the spin button 406.

Any known wireless signal may be used to relay the player's commands from the controller 400 to the corresponding remote-controlled figure 100. In various aspects, the wireless signal of each controller 400 may be different from any other controllers 400 associated with other remote-controlled figure 100 to ensure that each controller 400 controls only one associated remote-controlled figure 100. In another aspect, two or more controllers 400 may be associated with each remote-controlled figure 100 in the game 1000. In this aspect, each of the two or more controllers 400 may be used cooperatively by two or more players to add an additional cooperative element to the game play, or each of the two or more controllers 400 may be used non-cooperatively by opposing players to add an additional competitive element to the game play.

In an aspect, each controller 400 is associated with one of the at least two remote-controlled figure 100 of the game 1000. Each controller 400 may include a visual feature to identify the particular remote-controlled figure 100 controlled by that controller 400. Non-limiting examples of suitable visual features for each controller 400 include: a common color of each remote-controlled figure 100 and associated controller 400; and an external marking on each controller 400 associated with each remote-controlled figure 100 such as an image of the associated remote-controlled FIG. 100, a written name of the associated remote-controlled figure 100, and a surface adornment thematically associated with the associated remote-controlled figure 100. By way of non-limiting example, a controller 400 associated with a lizard figure 100 may be provided with a surface adornment in the form of scales, which are associated with the lizard character.

Non-limiting examples of suitable wireless signals include: any electromagnetic radiation signal including radio frequency (RF) signals; light signals such as infrared (IR) signals; acoustic signals at any known acoustic frequency; and any other wireless signal known in the art. In other aspects, players' commands may be transmitted to the commands from the controller 400 to the corresponding remote-controlled FIG. 100 via electrical signals carried by a conductive wire connecting the controller 400 and the remote-controlled figure 100.

Referring again to FIGS. 12A-12C, the forward button 404 and the spin button 406 may protrude outward from the casing 402 of the controller 400. The forward button 404 and the spin button 406 may be adjacent on the controller 400 and separated by a divider 407. In various aspects, the forward button 404 and the spin button 406 may be actuated in various sequences and patterns to command or direct various movements of the remote-controlled figure 100. The depression or actuation of the forward button 404 causes the remote-controlled figure 100 to move in a linear direction, such as forward. The depression or actuation of the spin button 406 causes the remote-controlled FIG. 100 to rotate or spin.

Figure 13A:
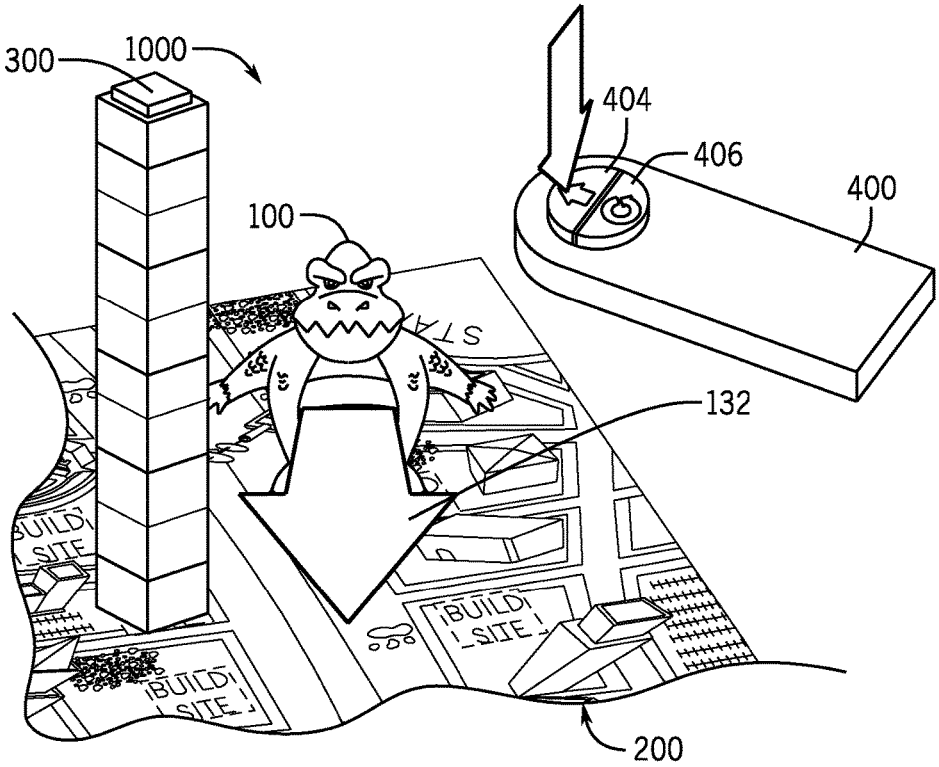
FIG. 13A is an illustration of a remote-controlled figure performing a forward movement on the game board.
Figure 13B:
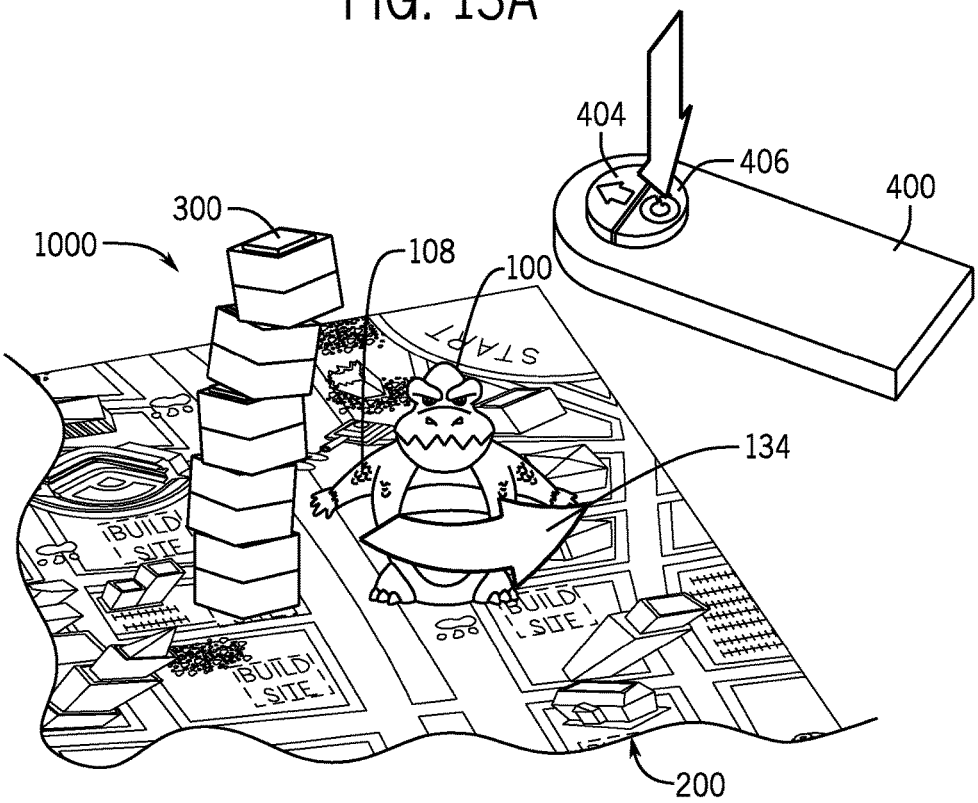
FIG. 13B is an illustration of a remote-controlled figure performing a spinning movement on the game board.
Figure 14:
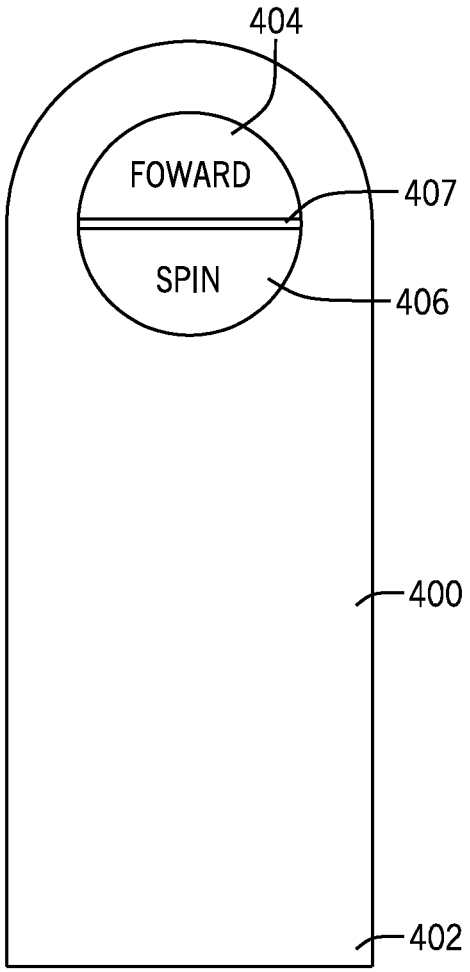
FIG. 14 is an illustration of a remote with an array of control buttons.

In one aspect, the forward button 404 and spin button 406 may be actuated to command movements of the remote-controlled figure 100. Referring to FIG. 13A, actuation, such as depression, of the forward button 404 may command a linear forward movement 132 of the remote-controlled figure 100. Referring to FIG. 13B, actuation, such as depression, of the spin button 406 may command a spinning movement 134 of the remote-controlled figure 100. The spinning movement 134 of the remote-controlled figure 100 changes the direction or orientation of the figure 100, such that further actuation of the forward button 404 will command the figure 100 to move in the direction chosen or resulting from the spinning movement 134. Simultaneous actuation of the forward button 404 and spin button 406 may command an arcuate or curving movement of the remote-controlled figure 100.

Also in this aspect, all movements of the remote-controlled figure 100 in any direction upon the game board 200 during game play may be accomplished using various combinations of the forward movement 132 and the spinning movement 134. By way of non-limiting example, the player may command a spinning movement 134 using the spin button 406 on the controller 400 until the remote-controlled figure 100 is facing in a desired direction, followed by actuation of the forward button 404 to command forward movement 132 of the remote-controlled figure 100.

Referring again to FIG. 13B, the spinning movement 134 may also be used to knock down a building model 300 of an opponent in another aspect. In this aspect, the arms 108 may be positioned to project laterally away from the torso 102 of the remote-controlled figure 100 in order to increase the radial distance away from the spinning remote-controlled figure 100 at which an arm 108 may strike a building model 300. In another aspect (not shown), the forward movement 132 may be used to knock down an opponent's building model 300.

In other aspects, actuations of the forward button 404 and the spin button 406 may be used to command additional motions for the remote-controlled figure 100 including, but not limited to: a left turn, a right turn, movement in a backwards direction, and the activation of the lights and/or sound effects in the remote-controlled figure 100.

In additional aspects, the controller 400 may include alternative interfaces used to command the movements of the remote-controlled figure 100. Non-limiting examples of suitable alternative interfaces for the controller 400 include: a joystick; any known game remote; a keyboard; a touchpad; a touch screen; an array of buttons; and any other known control interface.

IV. Building Models

Referring again to FIG. 3, the game 1000 may further include a plurality of building models 300. As discussed herein previously and as illustrated in FIG. 3, each building model 300 may be located on a build site 202 on the game board 200. Referring again to FIG. 1, the two or more remote-controlled figure 100 may move around the game board 200 during game play to knock over building models 300 of an opponent. In one aspect, each building model 300 generally has an elongated shape and is balanced on one end, allowing each building model 300 to be knocked over upon contact with a remote-controlled figure 100 with relative ease.

In one aspect (not shown), each building model 300 may be formed as a single integrated structure, corresponding to a single building unit 302. Referring again to FIG. 1, in other aspects each building model may be assembled by stacking two or more building units 302 in a vertical stack, resulting in an elongated stacked structure resting on the game board 200 at one end. Any number of building units 302 without limitation may be stacked to assemble each building model 300. Non-limiting examples of suitable numbers of building units 302 stacked within a building model 300 include: two building units 302, three building units 302, four building units 302, five building units 302, six building units 302, seven building units 302, eight building units 302, nine building units 302, ten building units 302, and greater than ten building units 302.

Figure 15A:
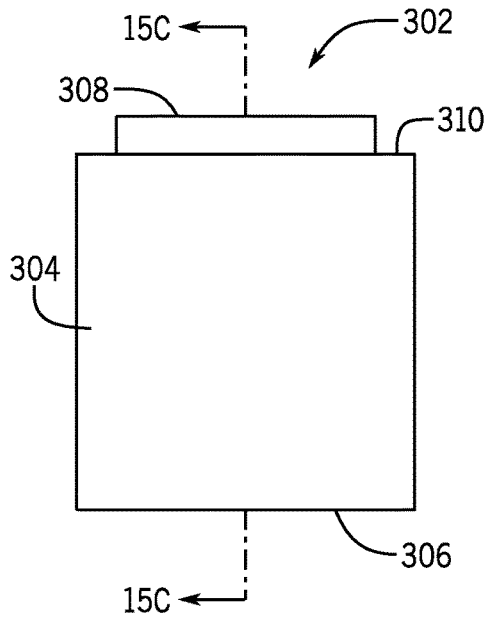
FIGS. 15A-15C are front, top, and cross-sectional views of a building unit, respectively.
Figure 15B:
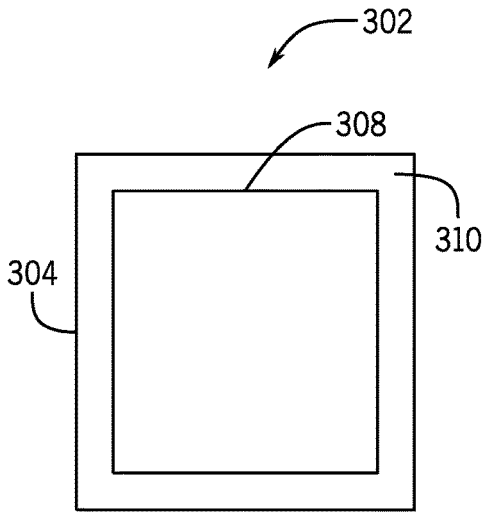
Figure 15C:
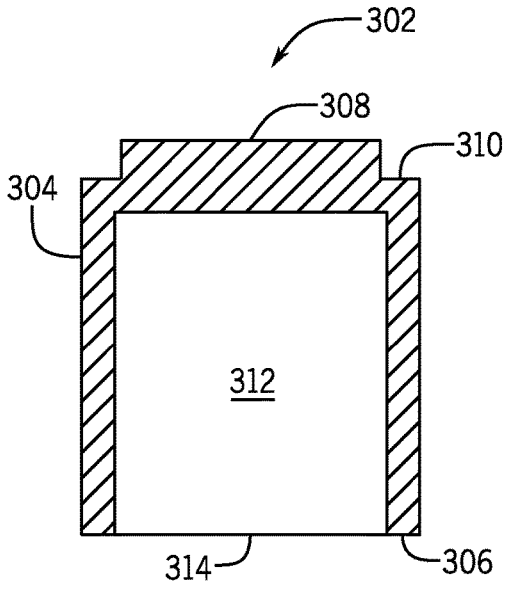

Referring to FIGS. 15A-15C, each building unit 302 may include a body 304 in an aspect. The body 304 may include a flat base 306 that provides a planar surface for resting on the top surface 205 of the game board 200 in a stable manner. The body 304 may further include a nub 308 projecting from the body 304 opposite to the base 306. A shoulder 310 formed at an intersection of the body 304 and the nub 308 may extend around the perimeter of the nub 308. The body 304 may further enclose an open-ended cavity 312 that opens to an opening 314 formed within the base 306.

Figure 16:
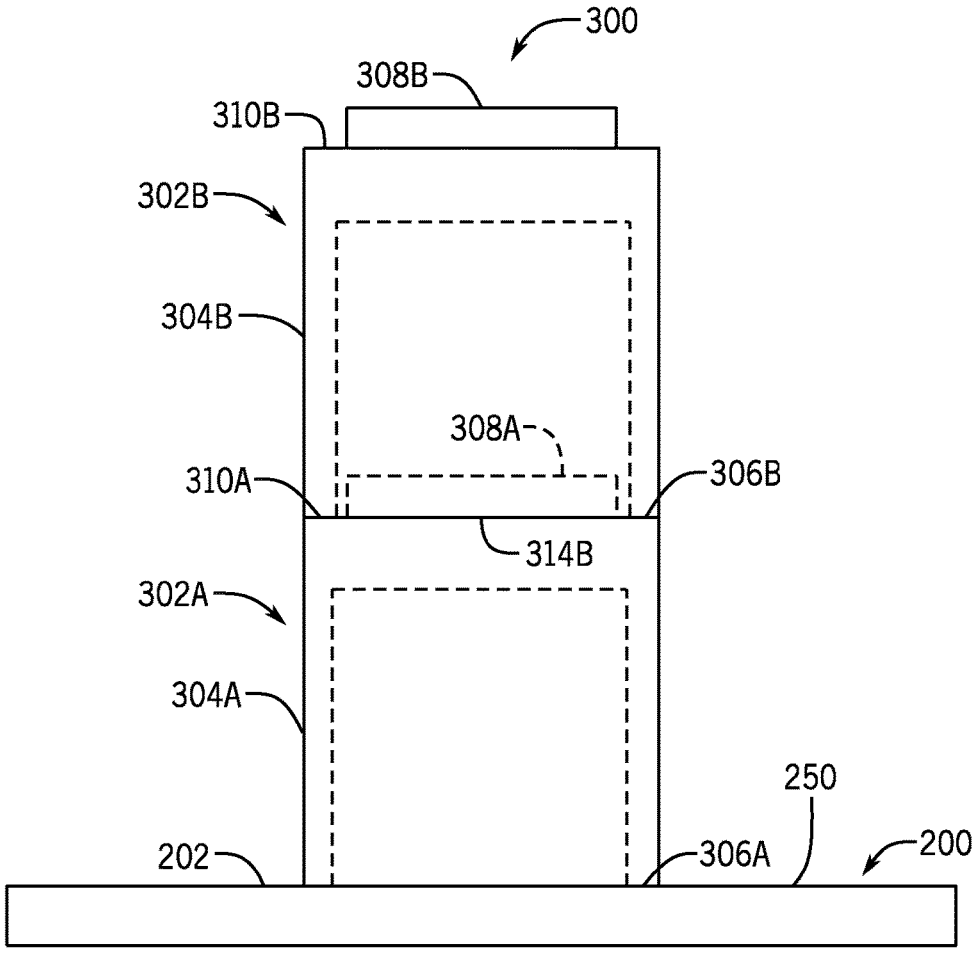
FIG. 16 is a side view of two building units stacked on a game board.

Referring to FIG. 16, the building units 302 may be stacked to form at least one building model 300. In an aspect, a first base 306A of a first building unit 302A may be placed on a build site 202 on the top surface 205 of the game board 200. A second building unit 302B may be stacked on top of the first building unit 302A by placing the second opening 314B over the first nub 308A. In this aspect, the second base 306B of the second building unit 302B rests upon the first shoulder 310A of the first building unit 302A, thereby supporting the second building unit 302B. An additional building unit 302 (not shown) may be stacked on the second building unit 302B in a similar manner, and successive building units 302 may be similarly stacked, until the desired height for the building model 300 is achieved.

In one aspect, each nub 308 may fit relatively loosely within each adjacent opening 314 in a building model 300. In this aspect, the loose fit between adjacent building units 302 provides for a frangible building model 300 for spontaneous separation of building units 302 when a building model 300 is knocked over during game play.

In various aspects, all building models 300 may be assembled to be of uniform height on the game board 200 prior to the initiation of game play. In various other aspects, one or more portions of the building models 300 may be assembled to be of varying heights within a predetermined range bounded by a minimum height and a maximum height. In these various other aspects, the assembly and placement of building models 300 with varying heights may introduce an additional strategic element into the game play.

In an aspect, the plurality of building units 302 may include at least two portions of building units 302. Each portion of building units 302 may be associated with one of the at least two remote-controlled figure 100. In an aspect, each building unit 302 within a portion associated with one of the at least two figure 100 may include a visual feature to identify the particular remote-controlled figure 100 associated with that portion of building units 302. Non-limiting examples of suitable visual features for each portion of building units 302 include: a common color of each remote-controlled figure 100 and associated building unit 302; and an external marking on each building unit 302 associated with each remote-controlled figure 100 such as an image of the associated remote-controlled figure 100, a written name of the associated remote-controlled FIG. 100, and a surface adornment thematically associated with the associated remote-controlled figure 100. By way of non-limiting example, a building unit 302 associated with a remote-controlled gorilla figure 100 may be provided with a surface adornment in the form of a bunch of bananas, which are thematically associated with the gorilla character.

In an aspect, the exterior surface of each body 304 of each building unit 302 may be provided with a relatively smooth surface texture. In another aspect, the exterior surface of each body 304 of each building unit 302 may be provided with a raised texture including, but not limited to protruding ridges, protruding nubs, and protruding spikes. In this other aspect, the raised texture may mechanically engage with a portion of a remote-controlled figure 100 such as an arm 108, thereby increasing the likelihood that a remote-controlled figure 100 may knock over a building model 300.

In various aspects, each building unit 302 may be any size or shape without limitation, provided each building unit 302 includes a flat base 306 and is stackable with other building units 302. Non-limiting examples of suitable shapes for building units include: a cube, a cylinder, and a brick shape. In various aspects, each building unit 302 may have a height of the body 304 measured from the base 306 to the nub 308 that is essentially equal to a width of the body 304.

In various aspects, the height of each building unit 302 may range from about 0.5 cm to about 5 cm. In various other aspects, the height of each building unit 302 may range from about 0.5 cm to about 0.7 cm, from about 0.6 cm to about 0.8 cm, from about 0.7 cm to about 0.9 cm, from about 0.8 cm to about 1 cm, from about 0.9 cm to about 1.1 cm, from about 1 cm to about 2 cm, from about 1.5 cm to about 2.5 cm, from about 2 cm to about 3 cm, from about 2.5 cm to about 3.5 cm, from about 3 cm to about 4 cm, from about 3.5 cm to about 4.5 cm, and from about 4 cm to about 5 cm.

In various aspects, the number of building units 302 provided with the game 1000 may range from about 4 to about 200. In various other aspects, the number of building units 302 provided with the game 1000 may range from about 6 to about 96, from about 8 to about 84, and from about 12 to about 48.

In various aspects, the assembled building models 300 may range from about 50% to about 150% of the heights of the at least two remote-controlled figure 100. In various other aspects, the assembled building models 300 may range from about 3 cm to about 30 cm. In various additional aspects, the assembled building models 300 may range from about 3 cm to about 5 cm, from about 4 cm to about 6 cm, from about 5 cm to about 7 cm, from about 6 cm to about 8 cm, from about 7 cm to about 9 cm, from about 8 cm to about 10 cm, from about 9 cm to about 11 cm, from about 10 cm to about 15 cm, from about 12 cm to about 18 cm, from about 15 cm to about 20 cm, from about 18 cm to about 23 cm, from about 20 cm to about 25 cm, from about 23 cm to about 28 cm, and from about 25 cm to about 30 cm.

In an aspect, the building models 300 may be relatively generic in design, as illustrated in FIG. 1. In another aspect, the building models 300 may be custom-designed to resemble existing buildings or fictional buildings. In this other aspect, the building models 300 may be designed in coordination with a customization of the game board 200 as described herein above. By way of non-limiting example, the game board 200 may include customized markings denoting a map of New York City, and the building models 300 may be custom designed to resemble landmarks associated with New York City including, but not limited to: the Empire State building, the Chrysler building, Rockefeller Center, the Statue of Liberty, and the like.

V. Method of Play

In various aspects, a method of playing a game that includes at least two remote-controlled figures moving on a game board to knock over at least one building model associated with an opponent includes at least two phases including, but not limited to: a turn-based phase and a real-time phase. In one aspect, the turn-based phase includes various actions performed by each of the players in a sequence determined by at least one or more sequencing rules described herein below. The actions performed during the turn-based phase generally include: selecting a particular remote-controlled figure and control as well as associated building units; assembling the building units into one or more building models and placing the models on one of a plurality of build sites on the game board; and placing the selected remote-controlled figure on one of a plurality of start sites on the game board. In another aspect, the real-time phase includes actions performed by the players of the game while moving the at least two remote-controlled figures around the board to knock down the building models according to one or more predetermined rules. Non-limiting examples of actions performed by the players of the game during the real-time phase include: initiating movement of all remote-controlled figures; returning a remote-controlled figure to play after falling over or leaving the game board; ending the real-time phase; and declaring a winner of the game.

In an aspect, the turn-based stage of the game may include each player selecting one of the at least two remote-controlled figures and one corresponding remote control. In this aspect, the players take turns selecting a remote-controlled figure and a controller in a first sequence determined by a first sequence rule. The first sequence rule may be any known sequence rule including a random sequence, an age-based sequence, or a sequence based on the winning status of a player in a previously played game. Non-limiting examples of suitable age-based sequences include a sequence according to each player's age selected from the oldest player to the youngest player or vice-versa. Non-limiting examples of suitable sequences based on the winning status of a player in a previously played game include a sequence based on the winner of the previously played game or the loser of the previously played game.

Once each player has selected a remote-controlled figure and controller, the player may obtain a plurality of building units associated with the selected remote-controlled figure.

In another aspect, the turn-based stage of the game may further include each player placing the selected remote-controlled figure on one of a plurality of start sites on a game board. In this other aspect, the players take turns in a second sequence according to a second sequence rule selected from one of: the first sequence used to choose the figures; a reverse sequence to the first sequence used to choose the remote-controlled figures; a second random sequence according to a random outcome as described herein previously; a second age-based sequence according to a sequence based on each player's age as described herein above, and a remote-controlled figure-related sequence according to a predetermined sequence of character placement. The predetermined sequence of character placement may be based on the character identity of a remote-controlled figure selected by a player. For example, if two players select a gorilla figure and a lizard character, respectively, the player that chose the gorilla figure may place this remote-controlled figure on the start site first according to a predetermined sequence in which the gorilla remote-controlled figure is placed first followed by the lizard character.

In an additional aspect, the turn-based phase of the game may further include each player situating each building model at one of a plurality of build sites on the game board. Each building model may be assembled by stacking at least two of the plurality of building units associated with that player's selected remote-controlled figure prior to situating each building model at a build site. In this additional aspect, the players may take turns in a third sequence determined by a third sequence rule. Non-limiting examples of suitable third sequence rules include: the first sequence or reverse of the first sequence used to choose the remote-controlled figures; the second sequence or a reverse of the second sequence used to place the remote-controlled figures on a start site; a third random sequence according to a random outcome as described herein previously; a third age-based sequence according to a sequence based on each player's age as described herein above, and a second figure-related sequence according to a predetermined sequence of character placement as described herein previously. In addition to the third sequence of turns taken by the players in this additional aspect, the actions taken by each player during a turn may include: 1) situating all of the building models associated with that player's remote-controlled figure in one turn, followed by the next player in the third sequence situating all associated building models, until all building models associated with all players' remote-controlled figures are situated; or 2) each player situating one of the building models associated with that player's remote-controlled figure, followed by a next player situating one of the building models associated with that next player's remote-controlled figure in a repeating cycle until all building models associated with all players' remote-controlled figures are situated.

In addition to the sequencing of turns and actions taken by each player during a turn, the distribution of building units among each player's building models and the number of building models assembled and placed on the game board by each player may also vary in various aspects. In one aspect, each building model for each player may include an equal number of building units to all other building models. In this one aspect, all building models may be of uniform size and each player may place an equal number of building models on the game board because typically an equal number of building units are associated with each remote-controlled figure chosen by each player. In another aspect, an equal number of building models may be associated with each player's remote-controlled figure. In this other aspect, each player may stack different numbers of building units to form each building model, and may be constrained only to produce a number of building models equal to the other players in the game. As a result, the building models on the game board may be of non-uniform height, adding an additional strategic element to the game play.

Figure 17:
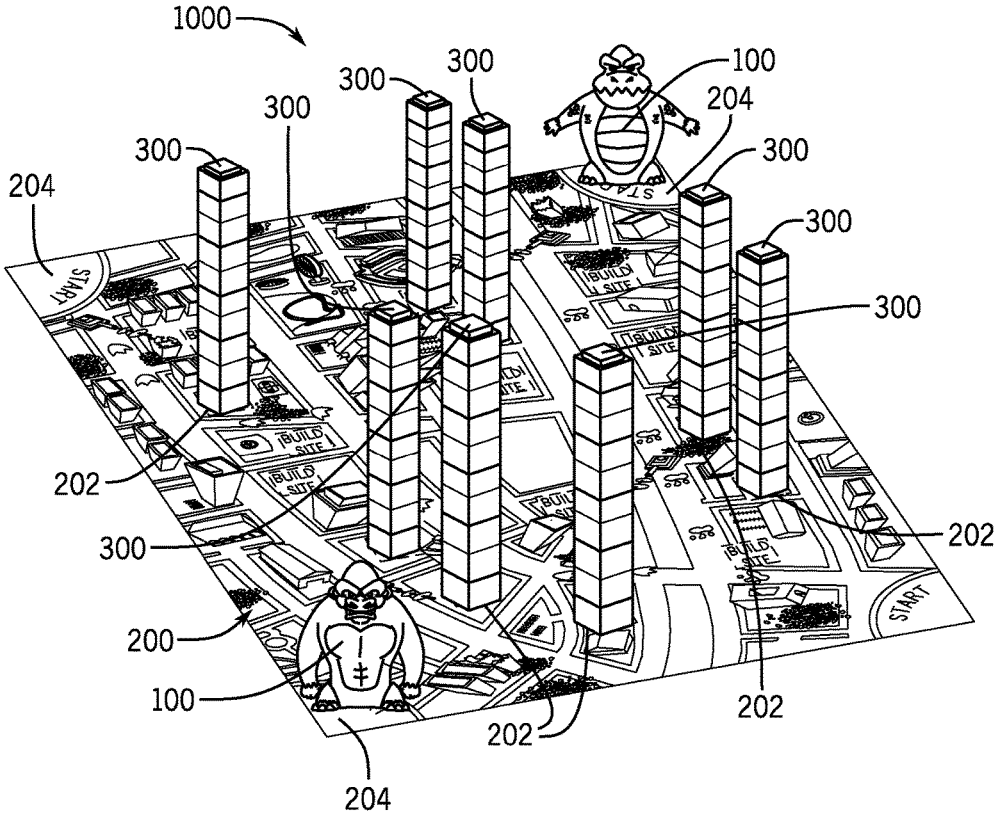
FIG. 17 is an illustration of remote-controlled figures and building models situated on a game board prior to game play.

Referring to FIG. 17, once the remote-controlled figure 100 and associated building models 300 are placed on the game board by all players, the real-time phase of the game may commence. During the real-time phase of the game, all players simultaneously move all remote-controlled figure 100 by manipulating each figure's corresponding remote control (not shown). In various aspects, the game may include a rule specifying how all players start moving all remote-controlled figure 100 simultaneously, including, but not limited to: all players hold all controllers (not shown) and start movement in response to a start signal, and all players pick up the controllers (not shown) and start movement of the remote-controlled figure 100 in response to the start signal. The start signal may be any known start signal including, but not limited to: a spoken countdown by one or more players; a word, tone, gesture or other indication made by one player; an agreed-upon time. In this aspect, the agreed-upon time may be indicated by a clock, an hourglass, or may be a tone or other indication produced by a timer or alarm.

Each player's remote-controlled figure 100 may move to knock over those building models 300 associated with that player's opponents and/or to interfere with the movements of the opponents' figures. In one aspect, the rules of the game may constrain each remote-controlled figure to use only the rotational mode of movement to knock over an opponent's building models. In another aspect, each player may use one or more movements to knock over an opponent's remote-controlled figure. If a player's remote-controlled figure 100 falls over, is knocked over by an opponent's remote-controlled figure 100, or leaves the game board 200, the rules of the game may provide for a way to return the fallen remote-controlled figure 100 to game play. In one aspect, the rules may provide that the player return the remote-controlled figure 100 to an upright position and/or return the remote-controlled figure 100 to the game board and resume play. In another aspect, the rules may provide that the player return the remote-controlled figure 100 to game play only via a start site 204 on the game board 200.

In various aspects, the rules of the game may provide for returning a remote-controlled figure to a new start site on the game board after that figure falls over or leaves the game board. The new start site to which the remote-controlled figure may be returned may be chosen from: the start site originally chosen for the remote-controlled figure; a start site nearest the location of the remote-controlled figure when the figure falls over or leaves the game board; a start site chosen by the player associated with the remote-controlled figure; or a start site chosen by an opponent of the player associated with the remote-controlled figure. The choice of rule by which a new start site is selected may introduce one or more strategies to the game. By way of one non-limiting example, the player may choose a new start site near an opponent's building models, or near an area unimpeded by fallen building models. An opponent may choose a new site for a player that is far from that opponent's building models or is obstructed by fallen building models. Further, a player may select build sites for that player's associated building models based on separation distance from the start sites likely to be used by an opponent's remote-controlled figures during game play.

In various aspects, the rules of the game may provide for declaring a winner of the game. In one aspect, a winner may be declared as the player with any standing building models after the building models of all other opponents are knocked over. In this aspect, a building model may be deemed "knocked over" when all building units of that building model directly contact the game board or surrounding playing surface. If each building model in a game comprises a single building unit, a building model may be deemed "knocked over" when the base of the building model ceases to contact the game board. In another aspect, the real-time phase of the game may proceed for a pre-determined time, after which all players stop movements of all remote-controlled figures. In this other aspect, the player with the most standing building units may be declared the winner of the game.

The foregoing merely illustrates the principles of the disclosure. Various modifications and alterations to the described embodiments will be apparent to those skilled in the art in view of the teachings herein. It will thus be appreciated that those skilled in the art will be able to devise numerous systems, arrangements and methods which, although not explicitly shown or described herein, embody the principles of the disclosure and are thus within the spirit and scope of the present disclosure. From the above description and drawings, it will be understood by those of ordinary skill in the art that the particular embodiments shown and described are for purposes of illustrations only and are not intended to limit the scope of the present disclosure. References to details of particular embodiments are not intended to limit the scope of the disclosure.

What is claimed is:

1. A board game for two players, the game comprising:

a first remote-controlled figure controlled by a first remote control;

a second remote-controlled figure controlled by a second remote control;

a first set comprising two or more building units, wherein at least one portion of the first set is stacked to form at least one first building model associated with the first remote-controlled figure;

a second set comprising two or more building units, wherein at least one portion of the second set is stacked to form at least one second building model associated with the second remote-controlled figure; and a game board comprising:

a plurality of start sites distributed throughout the game board, each start site marking a potential initial location for the first or second remote-controlled figure; and a plurality of build sites distributed throughout the game board, each build site marking a potential location of one of the first or second building models;

wherein:

each player controls movement of the first or second remote-controlled figure using the first or second remote control to knock over all building models associated with an opponent of that player.

2. The board game of claim 1, wherein each remote-controlled figure is configured to move about a top surface of the game board under the control of the remote.

3. The board game of claim 1, wherein each remote-controlled figure comprises a central torso ending in a head and a base at opposite ends of the torso, and one or more arms projecting laterally from the torso between the head and the base.

4. The board game of claim 3, wherein the one or more arms are selected from arms fixedly attached to the torso in position, and arms pivotally attached to the torso.

5. The board game of claim 1, wherein the first remote-controlled figure is in the form of a gorilla character and the second remote-controlled figure is in the form of a lizard character.

6. The board game of claim 1, wherein each remote control associated with each selected remote-controlled figure is identifiable by at least one of: a common color of each remote control and each figure; an external marking on each remote control associated with each remote-controlled figure, the external marking chosen from one or more of: an image of one remote-controlled figure, a written name of one remote-controlled figure, and a surface adornment associated with one remote-controlled figure.

7. The board game of claim 1, wherein each remote control comprises a forward button protruding outward from a casing of the remote control, wherein the forward button is actuated to command a linear forward movement of the associated remote-controlled figure, wherein each remote control comprises a spin button protruding outward from the casing of the remote control to command a spinning movement of the associated remote-controlled figure.

8. The board game of claim 1, wherein the building units are stackable in a vertical manner.

9. The board game of claim 1, wherein the building units are assembled in a vertical stack on a top surface of the game board.

10. The board game of claim 1, wherein each set of building units comprises 24 building units.

11. The board game of claim 1, wherein each set of building units comprises 24 building units, and wherein a portion of six building units of each set are stackable to form a building model.

12. The board game of claim 1, wherein each set of building units associated with each remote-controlled figure is identifiable by at least one of: a common color of each building unit associated with each remote-controlled figure; an external marking on each building unit associated with one remote-controlled figure, the external marking chosen from one or more of: an image of the one remote-controlled figure, a written name of the one remote-controlled figure, and a surface adornment associated with the one remote-controlled figure.

13. The board game of claim 1, wherein the game board comprises markings representing map features selected from streets, rivers, additional buildings, parks, and parking lots.

14. The board game of claim 1, wherein the game board comprises four start sites.

15. The board game of claim 1, wherein the plurality of start sites are distributed around an outer perimeter of the game board.

16. The board game of claim 1, wherein the number of build sites is greater than the total number of building models associated with each remote-controlled figure.

17. The board game of claim 1, wherein the build sites are distributed on a top surface of the game board in a distribution pattern wherein the distribution pattern is selected from random distribution, uniform distribution, clustered distribution, and distribution along markings or features of the game board.

18. A board game for at least two players, the game comprising:

at least two remote-controlled figures and associated remote controls;

a plurality of frangible building models, wherein a portion of the plurality of building models is associated with each of the at least two remote-controlled figures; and a game board comprising:

a plurality of start sites distributed throughout the game board, each start site marking a potential initial location for one of the at least two remote-controlled figures; and a plurality of build sites distributed within the outer perimeter of the game board, each build site marking a potential location of one of the plurality of building models;

wherein:

each player controls movement of one of the at least two remote-controlled figures using the associated remote control to knock over the portions of the building models associated with one or more opponents of that player.

19. The board game of claim 18, wherein the plurality of start sites are distributed around an outer perimeter of the game board.

20. The board game of claim 18, wherein the plurality of build sites are configured to receive the plurality of building models.

21. The board game of claim 18, wherein each frangible building model comprises a plurality of building units stacked on top of each other.

22. The board game of claim 21, wherein each frangible building model is assembled by stacking a plurality of building units, wherein the base of a first building unit rests on a build site, and a base of a second building is stacked on top of the first building unit in a repeating cycle until the frangible building model is assembled.

* * * * *